US005683751A

United States Patent [19]

Derule et al.

[11] Patent Number: 5,683,751

[45] Date of Patent: Nov. 4, 1997

[54] PROCESS FOR SURFACE TREATMENT OF SHEET STEEL PARTIALLY COATED WITH ZINC OR ZINC ALLOY

[75] Inventors: Hervé Derule, Metz; Jean Steinmetz, Laxou, both of France

[73] Assignee: Sollac, Puteaux, France

[21] Appl. No.: 685,961

[22] Filed: Jul. 22, 1996

[30] Foreign Application Priority Data

Jul. 21, 1995 [FR] France ..... 95 08822

[51] Int. Cl.[6] ..... B05D 3/02; B05D 7/14; B05D 1/38

[52] U.S. Cl. ..... 427/384; 427/156; 427/327; 427/402; 427/406

[58] Field of Search ..... 427/402, 406, 427/327, 384, 156, 433, 435, 419.1

[56] References Cited

U.S. PATENT DOCUMENTS

| | | | |
|---|---|---|---|
| 4,020,000 | 4/1977 | Suen et al. | 252/180 |
| 4,113,498 | 9/1978 | Rones et al. | 106/14.13 |
| 4,354,881 | 10/1982 | Tanikawa et al. | 148/6.14 R |
| 4,406,811 | 9/1983 | Christensen et al. | 252/180 |
| 4,414,125 | 11/1983 | Keil et al. | 252/75 |
| 4,647,392 | 3/1987 | Darden et al. | 252/75 |
| 4,649,025 | 3/1987 | Hwa et al. | 422/15 |
| 5,156,769 | 10/1992 | Cha et al. | 252/395 |
| 5,217,686 | 6/1993 | Vanderpool et al. | 422/16 |
| 5,385,655 | 1/1995 | Brent et al. | 427/409 |
| 5,391,396 | 2/1995 | Morrand | 427/419.1 |
| 5,507,861 | 4/1996 | Caupin et al. | 106/14.05 |

FOREIGN PATENT DOCUMENTS

| | | |
|---|---|---|
| A-0 038 364 | 10/1981 | European Pat. Off. . |
| A-0 556 087 | 8/1993 | European Pat. Off. . |
| A-0 564 721 | 10/1993 | European Pat. Off. . |

OTHER PUBLICATIONS

Abstract of JP–A–57114671, Oct. 1982.
Abstract of JP–A–56 062971 Aug., 1981.

*Primary Examiner*—Diana Dudash
*Attorney, Agent, or Firm*—Oblon, Spivak, McClelland, Maier & Neustadt, P.C.

[57] ABSTRACT

An aqueous solution useful for protecting steel from corrosion containing an alkaline aliphatic monocarboxylic acid salt having a linear chain of 6 to 12 carbon atoms, a triazole or diazole hydrocarbon and a non-ionic surfactant, the solution having a pH below 7. This aqueous solution is especially suited to the treatment of sheets at the outlet of an electrogalvanization line, particularly in a chloride medium.

8 Claims, No Drawings

PROCESS FOR SURFACE TREATMENT OF SHEET STEEL PARTIALLY COATED WITH ZINC OR ZINC ALLOY

BACKGROUND OF THE INVENTION

1. Field of the Invention

The present invention relates to the temporary protection against corrosion of steel partially coated with zinc or zinc alloy, particularly steel sheets coated with zinc or zinc alloy on only one side.

2. Discussion of the Background

After electrogalvanizing, sheet steel generally undergoes a surface anti-corrosion treatment. In the case of partial coating, particularly on only one side, the same treatment must be effective on both sides at one and the same time. This anti-corrosion treatment also must be effective on rolled sheets, during their storage period. If it develops, corrosion generally is manifested by stains on the coating and/or pitting on the exposed side.

Among the possible causes of corrosion are:

- the electrogalvanization baths, particularly the chloride baths;
- the treatments which surround electrogalvanization, particularly scouring, activation and rinsing;
- the atmosphere of the electrogalvanization line, which itself may be corrosive.

Rolling of the sheets brings the exposed portions and the coated portions of the sheet into contact, which increases the risk of corrosion.

Anti-corrosion treatment may consist in oiling the sheets at the electrogalvanization outlet. But the protection against corrosion provided by a simple oiling is insufficient. In order to improve protection, prior to oiling but always after electrogalvanization, it is known to treat the coated strips with the aid of a corrosion-inhibiting solution.

This inhibiting solution, apart from the fact that it must be suited at one and the same time to prevention of corrosion of the steel and that of the zinc or zinc alloy, also must make it possible to prevent corrosion deriving from exposed portion-coated portion contact, which unavoidably is caused when rolling the sheet. This solution generally is applied on both sides of the strip, by coating or spraying.

Application by coating, for example by an applicator roller, generally ensures a uniform distribution of the inhibiting solution which is suitable for a uniform treatment of the surface. The application process for the solution is thus appropriate for obtaining a homogenous film on the surface of the sheet to be protected. In order to improve the distribution of the solution on the strip, a wetting agent generally is introduced into the inhibiting solution.

The aqueous corrosion-inhibiting solutions used to date prior to oiling for the treatment of sheets have some drawbacks:

- the nitrosamine-based solutions are at risk of decomposing into carcinogenic products if the sheet is subsequently reheated.
- the solutions containing sodium nitrite and nitrogen may be effective on the exposed portions of the sheet but have a tendency to stain the coated portions of the sheet, particularly if the coating is of zinc-nickel alloy and, a fortiori, of pure zinc.
- the solutions containing sodium phosphate and nitrite, with a pH of approximately 7, generate effluents which are costly to dispose of or treat.

The use of nitrites also may have drawbacks in subsequent stages of transformation of the sheet: for example, at the time of scouring, there is a risk of polluting the scouring baths.

Aqueous corrosion-inhibiting solutions containing an alkaline aliphatic carboxylic acid salt having a linear chain of 6 to 12 carbon atoms, an alkaline borate and a triazole hydrocarbyl are known, particularly from the document EP-A-0 308 037. These solutions are used in closed cooling circuits, that is, in an application quite different from a protective treatment for a partially-coated sheet, in which the surface of the sheet is treated with a corrosion-inhibiting solution, then it is oiled.

As a matter of fact, in the area of cooling circuits:

- the issue of staining is not critical,
- the issue of compatibility, or even of synergy, of the components of the inhibiting solution with an oil does not arise,
- the risks of corrosion relate essentially to corrosion in a liquid medium, and not to atmospheric (air) corrosion as in the invention.

OBJECTS OF THE INVENTION

One object of the invention is to provide an improved temporary protection against corrosion for steel partially coated with zinc or zinc alloy, particularly sheet steel, while avoiding the drawbacks cited above, particularly the risks of staining and problems with oil distribution.

DETAILED DESCRIPTION OF THE INVENTION

The objects of the invention are provided by a process for surface treatment of steel, particularly sheet steel, partially or wholly coated, particularly on only one side, with a layer of zinc or zinc alloy, in which the surface of said steel or steel sheet is treated with an aqueous corrosion-inhibiting solution so as to deposit a homogeneous film on said surface after which oil is applied to said surface, characterized in that said aqueous solution contains an alkaline aliphatic monocarboxylic acid salt having a linear chain of 6 to 12 carbon atoms, a triazole and/or diazole hydrocarbon and a non-ionic tensio-active (surfactant) agent, and in that the pH of said solution is maintained at a value below 7 where % is % by wt. based on total weight of aqueous solution. This aqueous solution is also part of the invention.

The inhibiting solution used in the process according to the invention, provided it has a pH strictly below 7, for example 6.5 and below, makes it possible to prevent the occurrence of signs of corrosion on the exposed portions (pitting) or coated portions (stains) of the steel or steel sheet so treated, then oiled, even after prolonged storage in a roll.

An advantage of this inhibiting solution according to the invention is that it is less sensitive to the hazards of application; that is, it remains effective even if the conditions of application (for example: drying of the sheet, atmospheric conditions) fluctuate or are poorly controlled: it is therefore particularly easy to apply to the sheet.

The tensio-active agent of the inhibiting solution, of non-ionic type (non-ionic surfactant), improves not only the distribution of the inhibiting solution on the sheet, but also the compatibility of the components of this inhibiting solution with the oil applied later; the improvement of this compatibility further reinforces the efficacy of the protection against corrosion provided by the surface treatment according to the invention, including after rolling of the sheet ("intervolute" corrosion). Examples include polyethoxylated alcohols.

Preferably, in order to obtain good resistance to corrosion while preventing the risk of staining, the ratio between the molar concentration of the alkaline monocarboxylic acid salt in the inhibiting solution and the molar concentration of triazole and/or diazole hydrocarbon in this solution ranges from 0.4 to 10 including 1, 2, 3, 5, 8 and 9 and all values and ranges therebetween.

In order to apply the inhibiting solution to the surface to be treated, the treatment with the inhibiting solution preferably is adjusted in such manner that the film deposited at the time of this treatment has a surface density below 200 mg/m2, this surface density being measured for the dried film.

In effect, a relatively low deposition density makes it possible, at the time of the subsequent oiling in the treatment according to the invention, to obtain a uniform and homogeneous distribution of the oil advantageous for the efficacy of the protection against corrosion. As a matter of fact, it was noted that the alkaline aliphatic monocarboxylic acid salts of the invention inhibiting solution could bring about problems with wettability and therefore with distribution of the oil when the inhibiting-solution deposition density is too high.

Owing to the alkaline nature of the monocarboxylic acid salt of the inhibiting solution—that is to say that the cation of the salt is chosen from among the alkaline earth metals and alkali metals—conventional surface analysis processes easy to implement may be used to rapidly check the deposition density or the amount of product deposited on the surface of the sheet, and if need be, restore it to the required, adequate level.

The invention also may have one or several of the following preferred characteristics:

said triazole or diazole hydrocarbon is chosen from among 1-2-3 triazole, 1-2-4 triazole, 1-H benzotriazole (1, 2, 3), 5-alkyl 1-H benzotriazole (1, 2, 3), benzimidazole (or 1-3 benzodiazole), said monocarboxylic acid is heptanoic acid, said non-ionic tensio-active agent is of the family of polyethoxylated alcohols.

Particularly in the case of invention solutions containing alkaline heptanoic acid salt and tolyltriazole, the inhibiting solution according to the invention provides, with the protective oil, a better protection than other aqueous solutions of the prior art; and the two essential components, namely the alkaline heptanoic acid salt and the tolyltriazole, have a synergy in the inhibiting function.

The proportion of alkaline heptanoic acid salt and tolyltriazole in the inhibiting solution may be advantageously adjusted to the nature of the partial coating of the sheet to be protected:

when the coating of the sheet is of zinc-nickel alloy, the tolyltriazole concentration in said inhibiting solution ranges between 0.5 and 5 g/l.

when the coating of the sheet is of pure zinc, the tolyltriazole concentration in said inhibiting solution is more than 1.5 g/l and less than or equal to 5 g/l.

Finally, when the alkaline aliphatic monocarboxylic acid salt is a sodium heptanoate, the treatment with said aqueous solution preferably is carried out in such manner that the amount of sodium contained in said film deposited on the surface of the sheet ranges between 2 and 8.5 mg/m2.

EXAMPLES

The following examples illustrate the invention:

Example 1

The purpose of this example is to illustrate the protection against corrosion provided by the inhibiting solution used in the process according to the invention.

For this purpose, the electric current is measured in terms of time between an exposed steel electrode and a zinc-coated steel electrode immersed in an inhibiting solution to be tested.

The solutions to be tested are prepared by diluting the corrosion-inhibiting products in water designated as "ASTM": no basic or acid agent is added to these solutions, all of which have a pH designated as "natural."

The water designated as "ASTM" contains 165 mg/l of sodium chloride, 138 mg/l of sodium bicarbonate and 148 mg/l of sodium sulfate.

The electric current measured decreases in terms of the time, then becomes approximately constant at the end of a certain time, designated as passivation time, or "Pass. time, "measured in kiloseconds (k.s.).

This approximately constant stage of the electric current is called "level."

The table below shows the results provided by the various solutions:

| Solution | Pass. time—k.s. | Level—μA/cm$^2$ |
|---|---|---|
| "ASTM" water (corrosion reference) | 6.00 | 40.00 |
| Tolyltriazole (TTA)—1 g/l | 0.03 | 20.00 |
| Sodium heptanoate (NaC7)—6 g/l | 0.07 | 7.00 |
| TTA at 0.5 g/l and NaC7 at 6 g/l—pH # 6.5 | <0.01 | 0.03 |

It is noted, therefore, that the solution according to the invention thus provides better protection than other solutions of the prior art and that the two components of the inhibiting solution used in the process according to the invention, represented by tolyltriazole and sodium heptanoate, have a synergy.

Example 2

The purpose of this example is to illustrate that sheet steel, coated with a layer of zinc-nickel on one side and treated with the aid of the inhibiting solution used in the process according to the invention, is not at risk of becoming stained on the coated side, even if the coated side is placed in contact with the exposed side (replication of "intervolute" corrosion conditions).

The following test makes it possible to evaluate the risk of staining after treatment with an inhibiting solution to be tested:

the following solutions are prepared:

S0: distilled water (for reference test)

S1: solution of sodium phosphate and nitrite in distilled water, according to the prior art.

This S1 solution is obtained from the following principal components: Na3PO4, 12 H2O, H3PO4 and NaNO2, so that it contains 2.25 g/l of Na+ ions and 2.5 g/l of NO2− ions and has a pH of approximately 6.5.

The solution also contains a wetting agent known commercially as S4478 from the SURFAZUR Company.

S2: several solutions according to the invention, in distilled water, containing 6 g/l of sodium heptanoate (or 0.04 mole/l), 1 g/l of non-ionic wetting agent and various proportions of tolyltriazole (hereinafter designated as TTA): S2a: 0.5 g/l (or 0.0044 mole/l)—S2b: 1 g/l—S2c: 3 g/l—S2d: 5 g/l, all these solutions having a pH designated as "natural" below 7.

As a non-ionic wetting agent, the product known commercially as MAGNUSPRAY AD from the HENKEL Company is used; this product belongs to the family of polyethoxylated alcohols.

the coated side of several samples of sheet steel, previously scoured, is sprayed with the solution to be tested.

then piles are made by stacking samples coated face against exposed face, called FR/FN.

Each pile is clamped down with the same clamping force; these conditions replicate the overlapping of the sheets coated on only one side in a roll, or the conditions of intervolute corrosion.

the piles are stored for three days in the open air.

finally, the piles are dismantled in order to evaluate the surface appearance of the coated sides.

The surface appearance is distributed on a scale with 3 ratings: +++ for heavy staining, ++ for a moderate staining, + for a stain-free surface appearance.

According to the treatment solution used, observation of the surface of the samples yields the following results:

| Solution | S0 | S1 | S2a | S2b | S2c | S2d |
|---|---|---|---|---|---|---|
| FR/FN sides | +++ | + | + | + | + | + |

The solutions according to the invention are suitable for the prevention of stains on a zinc-nickel coating, as well as a solution of sodium phosphate and nitrite, according to the prior art, seeing that the concentration of tolyltriazole in the solution is at least equal to 0.5 g/l (case S2a), or that the NaC7/TTA molar ratio is approximately below 10.

The solutions according to the invention generate effluents less costly to treat than solution S1 of the prior art.

Example 3

The purpose of this example is to demonstrate that the treatment of sheet steel coated on one side with the aid of the solution according to the invention protects the exposed side of the sheet steel against the risks of corrosion, particularly pitting.

As a matter of fact, the exposed sides of steel coated on the other side with a zinc-nickel coating are particularly difficult to protect because of the simultaneous presence on this exposed side of traces of chlorides and nickel salts, which increase the reactivity of the surface.

The following test makes it possible to evaluate the risk of corrosion after application of an inhibiting solution to be tested:

1 - samples of steel sheet coated on only one side with a layer of zinc-nickel alloy, deriving directly from an industrial line, are sprinkled with a corrosive chloride solution.

A corrosive chloride solution known in itself, representative of the electrolyte currently used for performing industrial electrolytic depositing, containing in particular the compounds ZnCl2 and KCl, is selected.

2 - inhibiting solutions are prepared as in example 2:

S1: solution according to the prior art identical to the solution of example 2 (nitrite + phosphate).

S3: solution according to the invention: 1 g/l of wetting agent, 1.5 g/l of tolyltriazole (or 0.013 mole/l) and various proportions of sodium heptanoate (NaC7) :S3a:NaC7 at 3 g/l—S3b:NaC7 at 6 g/l—S3c:NaC7 at 12 g/l (0.08 mole/l).

The wetting agent is the same as in example 2.

3 - the solution to be tested then is applied to the samples.

In order to apply the solution to the samples, spraying or coating may be employed; in general owing to the use of an applicator roller in contact with the sheet, application by coating ensures a more homogeneous distribution of the solution on the surface to be treated than application by spraying.

4 - finally the samples are oiled, to deposit a uniform film of approximately 1 g/m2.

A conventional oil for temporary protection against corrosion is used, here for example the oil known commercially as 4107S from the FUCHS Company.

5 - the samples then are placed in a climatic testing chamber to have them undergo the following cycle several times:

8 h at 20° C. in the moist phase (relative humidity: 95%).

16 h at 20° C. in the dry phase (relative humidity: 30%).

6 - finally, during the progression of these cycles, the surface appearance of the exposed sides of the samples, and its evolution in terms of time, is evaluated.

The surface appearance is distributed on a scale with eight ratings: 0 for absence of corrosion . . . up to 8 for a very severe corrosion.

A reference test is provided without carrying out step No. 3, that is, oiling the surface directly, without prior treatment; the abbreviation "ref.: oil" designates this test.

The table below illustrates the evolution of the surface appearance in terms of the time (0 to 90 h) spent by the samples in the climatic testing chamber.

By applying the inhibiting solutions to be tested by spraying, the following corrosion rating is obtained for the exposed faces after testing in accordance with the above procedure:

| Time | 0 h | 15 h | 25 h | 45 h | 65 h | 90 h |
|---|---|---|---|---|---|---|
| ref. oil | 0 | 1.0 | 3.5 | 4.5 | 5.0 | 5.0 |
| S1 | 0 | 0.5 | 3.5 | 4.0 | 4.5 | 4.5 |
| S3(a to c) | 0 | 0 | 2.5 | 3.0 | 3.5 | 4.0 |

The solutions according to the invention thus would provide, on the exposed portions of a sheet partially coated with zinc-nickel, an improvement on the order of 25% in resistance to corrosion with respect to a conventional solution containing nitrites and phosphates.

The resistance to corrosion is nearly the same for all the S3(a to c) solutions, that is, for concentrations of sodium heptanoate ranging between 3 and 12 g/l and for NaC7/TTA molar ratios ranging between 1.5 and 6.

By applying the same inhibiting solutions by coating, the following rating is obtained for corrosion on the exposed sides after testing in accordance with the above procedure:

| Time | 0 h | 15 h | 25 h | 45 h | 65 h | 90 h |
|---|---|---|---|---|---|---|
| ref. oil | 0 | 2.2 | 3.2 | 3.8 | 4.4 | |
| S1 | 0 | 0.4 | 0.8 | 1.2 | 1.5 | |
| S3(a to c) | 0 | 0 | 0 | 0 | 0 | 0 |

When they are applied by coating, the solutions according to the invention thus provide an improvement in the resistance to corrosion to an even greater degree, with respect to inhibiting solutions of the prior art; in this example, the degree of improvement is in effect considerably greater than 25%.

The sodium deposited on the surface of the sheet in the two modes of application—spraying and coating was analyzed: the table below indicates the amount of sodium per unit of surface (in mg/m2), which reflects the amount of sodium heptanoate deposited for the solutions according to the invention (the heptanoate concentrations are cited in parentheses).

| application by | S3a (3 g/l) | S3b (6 g/l) | S3c (12 g/l) |
|---|---|---|---|
| spraying | 2.0 mg/m2 | 4.5 mg/m2 | 8.5 mg/m2 |
| coating | 2.0 mg/m2 | 3.5 mg/m2 | 5.0 mg/m2 |

Thus, for a sodium deposition ranging between 2 and 8.5 mg/m2 corresponding to a sodium heptanoate deposition ranging between 13 and 56 mg/m2, an improvement in resistance to corrosion is obtained.

In the case of an inhibiting solution in which the NaC7/TTA molar ratio would amount to 0.4, the total amount of inhibiting products deposited on the surface of the sheet thus could reach at most 200 mg/m2.

It is noted that the mode of application by coating leads to a lesser deposition density but nonetheless to a better resistance to corrosion than the mode of application by spraying.

An excessive deposition density may be detrimental to the good distribution of the oil and thus to the resistance to corrosion.

It also was noted that the wetting agent contained in the inhibiting solutions—cf. step No. 2—contributed not only to a uniform distribution of the anti-corrosion treatment solution (step No. 3), but also to a uniform distribution of the layer of oil (step No. 4).

In other tests not described here, inhibiting solutions were formulated with other wetting agents, which did not belong to the family of polyethoxylated alcohols, particularly fluorinated non-ionic wetting agents marketed by the ATOCHEM Company.

It was noted that these wetting agents were less suitable for performing the dual function of distribution of the solution and distribution of the layer of oil, and that the sheet, treated with solutions containing these wetting agents, then oiled, is less resistant to corrosion.

Example 4

The purpose of this example is to demonstrate that sheet steel coated with a layer of pure zinc on one side and treated with the aid of the solution according to the invention is not at risk of becoming stained on the coated side, unlike with other solutions of the prior art.

By sheet steel coated with a layer of "pure zinc" is meant conventional galvanized sheet steel.

The same types of tests as in example 2 are undertaken, but on samples of sheet steel galvanized on one side.

As in example 2, the surface appearance of the coated sides is distributed on a scale with three ratings: +++ for heavy staining, ++ for a moderate staining, + for a stain-free surface appearance.

The same solutions as in example 2 are adopted again, except with the difference that solution S2b is replaced by solution S'2b which contains 1.5 g/l instead of 1 g/l of tolyltriazole.

Observation of the surface of the samples yields the following results:

| Solution | S0 | S1 | S2a | S'2b | S2c | S2d |
|---|---|---|---|---|---|---|
| FR/FN sides | +++ | ++ | +++ | ++ | + | + |

The solutions according to the invention thus provide a more effective protection against staining than solution S1 of the prior art, seeing that the concentration of tolyltriazole in the solution is greater than 1.5 g/l.

Example 5

This example has the same purpose as example 3, applied to the case of sheet steel coated with pure zinc on one side.

The same tests as in example 3 are conducted, here applying the same inhibiting solutions only by spraying, but using two different types of oil for temporary protection:

oil A: designated commercially as 6130 from the QUAKER Company.

oil B: mixture of a mineral oil designated as "Sn" from the SHELL Company and an anti-corrosion additive designated as "Q" from the QUAKER Company.

The surface appearance of the samples is distributed on a scale with eight ratings: 0 for absence of corrosion. . . . up to 8 for a very severe corrosion.

Two reference tests are provided, oiling the surface directly without prior treatment, designated as "ref. oil A" and "ref. oil B."

The table below illustrates the evolution of the surface appearance in terms of the time (0 to 90 h) spent by the sample in the climatic tests chamber.

By applying oil A, the following corrosion rating is obtained for the exposed sides after testing in accordance with the above procedure:

| Time | 0 h | 15 h | 25 h | 40 h | 70 h |
|---|---|---|---|---|---|
| ref. oil A | 0 | 3.2 | 4.5 | 5.0 | 6.5 |
| S1 | 0 | 2.7 | 3.2 | 3.5 | 4.5 |
| S3a | 0 | 1.7 | 2.0 | 2.5 | 3.5 |
| S3(b and c) | 0 | 1.2 | 1.7 | 2.2 | 3.0 |

Thus as in example 3 (spraying case), the resistance to corrosion on the exposed side is improved by more than 25% with respect to a conventional solution containing nitrites and phosphates.

The resistance to corrosion increases slightly here with the concentration of sodium heptanoate.

By applying oil B, the following corrosion rating is obtained for the exposed sides after testing in accordance with the above procedure:

| Time | 0 h | 15 h | 25 h | 40 h | 70 h | 90 h |
|---|---|---|---|---|---|---|
| ref. oil B | 0 | 0.5 | 0.7 | 1.2 | 2.2 | 2.7 |
| S1 | 0 | 0 | 0.5 | 0.5 | 1.0 | 1.5 |
| S3a | 0 | 0 | 0.2 | 0.5 | 1.0 | 1.7 |
| S3(b and c) | 0 | 0 | 0.5 | 0.7 | 1.5 | 2.0 |

In the case of oil B, the resistance to corrosion is almost identical, whether solution S1 of the prior art or solutions S3 according to the invention are used; here, above a concentration of 3 g/l of sodium heptanoate in the solution, the resistance to corrosion remains at almost the same level.

Example 6

The purpose of this example is to illustrate the significance of the pH value of the corrosion-inhibiting solution which is used when the process according to the invention is implemented.

As a matter of fact, all the solutions according to the invention in the preceding examples are used at their "natural" pH, that is, a pH below 7.

An inhibiting solution S6/0 is prepared containing 3 g/l of sodium heptanoate and 5g/l of tolyltriazole and the same wetting agent as in solutions S2 of example 2.

Without other additives, the inhibiting solution obtained, S6/0, has a "natural" pH of approximately 6.5.

Through the addition of ammonia to this solution S6/0, there then is prepared an S6/1 solution with pH=7, then an S6/2 solution with pH=10.

The S6/0, S6/1 and S6/2 solutions then are tested in accordance with the same procedure as in example 2.

According to the treatment solution used, observation of the surface of the samples yields the following results:

| Solution | S6/0 | S6/1 | S6/2 |
|---|---|---|---|
| FR/FN sides | + | ++ | ++ |

The inhibiting solutions containing an alkaline aliphatic monocarboxylic acid salt having a linear chain of 6 to 12 carbon atoms, a triazole or diazole hydrocarbyl and a non-ionic tensio-active agent, therefore are suitable for implementation of the process according to the invention, provided that they have a pH strictly below 7.

This application is based on French patent application 95 08822 filed Jul. 21, 1995, incorporated herein by reference. In all instances herein, more than one of each component can be used in combination. All invention components are commercially available or capable of synthesis by those of ordinary skill based on their structures.

What is claimed as new and desired to be secured by Letters Patent of the United States is:

1. A process for surface treatment of a sheet steel wholly or partially coated with a layer of zinc or zinc alloy, in which a) the surface of said sheet is treated with an aqueous corrosion-inhibiting solution to deposit a film of said solution on said surface, b) said film is dried on said surface, and c) optionally oil is applied to said surface having said dried film thereon, wherein said aqueous solution comprises at least one alkaline earth metal or alkali metal aliphatic monocarboxylic acid salt having a linear chain of 6 to 12 carbon atoms, at least one of a triazole or diazole hydrocarbon and at least one non-ionic surfactant, and wherein the pH of said solution is at a value below 7.

2. The process according to claim 1, wherein the ratio between the molar concentration of said monocarboxylic acid salt in said solution and the total molar concentration of the triazole and diazole hydrocarbon in said solution ranges from 0.4 to 10.

3. The process according to claim 1, wherein treatment with said aqueous solution is carried out in such manner that said deposited film has a surface density of less than 200 mg/m2, said surface density being measured for said dried film.

4. The process according to claim 1, wherein said at least one of a triazole or diazole hydrocarbon is selected from the group consisting of one or more of 1-2-3 triazole, 1-2-4 triazole, 1-H benzotriazole (1, 2, 3), 5 alkyl 1-H benzotriazole (1, 2, 3), benzimidazole (or 1-3 benzodiazole).

5. The process according to claim 1, wherein:

said monocarboxylic acid salt is a salt of heptanoic acid, said triazole or diazole hydrocarbyl is tolyltriazole (5-methyl 1-H benzotriazole), said non-ionic surfactant is a polyethoxylated alcohol.

6. The process according to claim 5, wherein said coating is a zinc-nickel alloy, and said solution comprises tolyltriazole in an amount of from 0.5 to 5 g/l.

7. The process according to claim 5, wherein said coating is pure zinc, and said solution comprises tolyltriazole in an amount of more than 1.5 g/l and less than or equal to 5 g/l.

8. The process according to claim 1, wherein said alkaline aliphatic monocarboxylic acid salt is sodium heptanoate, and the treatment with said aqueous solution is carried out in such manner that the amount of sodium contained in said film deposited on the surface of the sheet ranges between 2 and 8.5 mg/m2.

* * * * *